US010786847B2

(12) United States Patent
Kuwano et al.

(10) Patent No.: US 10,786,847 B2
(45) Date of Patent: Sep. 29, 2020

(54) HYDRAULIC FORGING PRESS AND METHOD FOR CONTROLLING SAME

(71) Applicant: JAPAN AEROFORGE, LTD., Okayama (JP)

(72) Inventors: Hiroaki Kuwano, Okayama (JP); Shinya Ishigai, Okayama (JP)

(73) Assignee: JAPAN AEROFORGE, LTD., Okayama (JP)

( * ) Notice: Subject to any disclaimer, the term of this patent is extended or adjusted under 35 U.S.C. 154(b) by 419 days.

(21) Appl. No.: 15/524,101

(22) PCT Filed: Oct. 29, 2015

(86) PCT No.: PCT/JP2015/080630
§ 371 (c)(1),
(2) Date: May 3, 2017

(87) PCT Pub. No.: WO2016/072354
PCT Pub. Date: May 12, 2016

(65) Prior Publication Data

US 2017/0312810 A1 Nov. 2, 2017

(30) Foreign Application Priority Data

Nov. 3, 2014 (JP) ..... 2014-223857

(51) Int. Cl.
*B21J 9/12* (2006.01)
*B30B 1/34* (2006.01)
(Continued)

(52) U.S. Cl.
CPC ..... *B21J 9/12* (2013.01); *B30B 1/34* (2013.01); *B30B 15/163* (2013.01); *B30B 15/22* (2013.01)

(58) Field of Classification Search
CPC .. B30B 1/32; B30B 1/34; B30B 15/16; B30B 15/161; B30B 15/163; B30B 15/165;
(Continued)

(56) References Cited

U.S. PATENT DOCUMENTS 3,888,168 A * 6/1975 Kent ..... B30B 15/20 100/48
6,634,205 B2 10/2003 Yashima et al.
(Continued)

FOREIGN PATENT DOCUMENTS

CN 201257486 6/2009
CN 102725135 10/2012
(Continued)

OTHER PUBLICATIONS

Machine translation for JP-H04228298, Tokuji et al., pp. 1-18, retrieved Jun. 25, 2019. (Year: 2019).*
(Continued)

*Primary Examiner* — Shelley M Self
*Assistant Examiner* — Katie L. Parr
(74) *Attorney, Agent, or Firm* — Porcopio, Cory, Hargreaves & Savitch LLP

(57) ABSTRACT

A hydraulic forging press machine and a control method, whereby surging of the forging load or dead zones where the forging speed goes to zero is suppressed, and forging is performed with high precision throughout a wider range than the prior art, from low to high load. Pressure cylinders have a main pressure cylinder configured so working fluid is supplied during forging, and secondary pressure cylinders are configured so supplying and stopping of the supply of working fluid thereto are switched in response to the forging load, head-side hydraulic chambers of the secondary pressure cylinders being connected to a head-side hydraulic chamber of the main pressure cylinder via electromagnetic
(Continued)

switching valves. Only the main pressure cylinder is used until the forging load exceeds a set load, and the number of secondary pressure cylinders used is sequentially increased as the forging load increases after the forging load exceeds the set load.

8 Claims, 7 Drawing Sheets

(51) Int. Cl.
*B30B 15/22* (2006.01)
*B30B 15/16* (2006.01)

(58) Field of Classification Search
CPC ..... B30B 15/166; B30B 15/20; B30B 15/22; B21J 9/12
USPC ..... 72/19.9; 100/48, 50
See application file for complete search history.

(56) References Cited

U.S. PATENT DOCUMENTS

| | | | | |
|---|---|---|---|---|
| 8,112,215 | B2 * | 2/2012 | Wang | B60W 50/0098 701/93 |
| 8,689,685 | B2 * | 4/2014 | Lawrence | A21C 11/006 100/315 |
| 2002/0062676 | A1 * | 5/2002 | Yashima | B30B 15/163 72/443 |
| 2004/0094048 | A1 * | 5/2004 | Yamanaka | B30B 15/16 100/269.01 |
| 2007/0251400 | A1 * | 11/2007 | Glass | B30B 15/163 100/269.01 |
| 2008/0134909 | A1 * | 6/2008 | Kohno | B30B 1/32 100/48 |
| 2012/0272840 | A1 * | 11/2012 | Kurz | B30B 15/161 100/50 |

FOREIGN PATENT DOCUMENTS

| | | |
|---|---|---|
| JP | S54-84683 | 11/1977 |
| JP | S5484683 | 7/1979 |
| JP | H04228298 | 8/1992 |
| JP | H6-5735 | 1/1994 |
| JP | H06005735 | 1/1994 |
| JP | 2575625 | 1/1997 |
| JP | S4910176 | 4/2012 |
| JP | 2013510719 | 3/2013 |
| JP | H5461206 | 1/2014 |
| RU | 2374024 | 11/2009 |
| RU | 2468919 | 12/2012 |
| SU | 1447697 | 12/1988 |
| WO | 2011057773 | 5/2011 |
| WO | 2011057773 A2 | 5/2011 |

OTHER PUBLICATIONS

Machine translation for CN-201257486, Feng, pp. 1-6, retrieved Jun. 25, 2019. (Year: 2019).*
Office Action for related CN App No. 201580056253.3 dated Feb. 2, 2019, 7 pgs.
Notice of Reasons for Rejection for JP App No. 2014-223857 dated Jan. 29, 2015, 9 pgs.
Office Action for related CA App No. 2,966,477 dated Feb. 1, 2018, 4 pgs.
Office Action for related CN App No. 201580056253.3 dated Jun. 1, 2018, 9 pgs.
Office Action for related KR App No. 10-2017-7015014 dated Jul. 25, 2018, 22 pgs.
Search Report for related RU App No. 2017117716/02(030728), dated May 28, 2018, 2 pgs.
Office Action for related RU App No. 2017117716/02(030728), dated Jun. 20, 2018, 10 pgs.
Extended European Search Report for PCT/JP2015/080630 dated Oct. 20, 2017, 8 pages.
Office Action for related CA App No. 2,966,477 dated Oct. 26, 2018, 3 pgs.
Office Action for related RU App No. 2017117716/02(030728) dated Nov. 16, 2018, 10 pgs.

* cited by examiner

HYDRAULIC FORGING PRESS AND METHOD FOR CONTROLLING SAME

CROSS-REFERENCE TO RELATED APPLICATIONS

This application is a U.S. National Stage entry of PCT Application No. PCT/JP2015/080630, filed on Oct. 29, 2015, which claims priority to Japanese Patent Application No. 2014-223857, filed Nov. 3, 2014, the contents of which are incorporated herein by reference.

TECHNICAL FIELD

The present invention relates to a hydraulic forging press and a method of controlling the same, and in particular, to a hydraulic forging press that is capable of highly accurately forging over a wide range from a low load to a high load and a method of controlling the same.

BACKGROUND ART

By way of example, an extremely large forging press having a forging load capacity of about fifty thousand tons is installed in a large forging plant that forges aircraft component parts and the like. On the other hand, in a case in which component parts that require only a load of, for example, ten thousand tons or less are produced, a medium-sized forging press having a forging load capacity of, for example, about fifteen thousand tons is separately installed for a forging process. In other words, in a conventional large forging factory, several kinds of forging presses from a large size to a small size are installed depending on the forging loads, or otherwise a material that can be forged at a low load is transported to a separate forging plant provided with a medium-sized or small-sized forging press for a subsequent forging.

As described above, in the case in which all kinds of forging presses required for a large forging plant are installed, a considerable amount of initial investment is required, and it has been accordingly difficult for only one company to cope with this issue. Also, because a large hydraulic forging press uses an enormous amount of hydraulic oil during forging, a massive amount of energy is consumed. Accordingly, it has been desired that the large hydraulic forging press be technically improved in terms of energy saving.

FIG. 6 is an overall block diagram showing an example of a conventional large hydraulic forging press. The illustrated hydraulic forging press includes a slide S having an upper die D1, a bed B having a lower die D2, five pressure cylinders C1 to C5 for exerting pressures on the slide S, a plurality of pumps P for supplying the pressure cylinders C1 to C5 with hydraulic oil, a prefill tank Tp for supplementarily supplying the pressure cylinders C1 to C5 with the hydraulic oil, a plurality of support cylinders Cs for supporting the slide S from below, and an oil tank To for storing the hydraulic oil therein. The respective pumps P are configured so as to be selected for subsequent use depending on the use conditions by opening or closing respective shutoff valves. Also, the pressure cylinders C1 to C5 are connected to the prefill tank Tp via respective check valves so as to be supplementarily supplied with the hydraulic oil from the prefill tank Tp at the same time as the supply of the hydraulic oil from the pumps P. It should be noted here that pumps for supplying the support cylinders Cs with the hydraulic oil are not shown.

The above-mentioned conventional example can change the number of the pumps P to be used depending on the forging conditions. However, the hydraulic oil is simultaneously supplied to all of the pressure cylinders C1 to C5 so that the slide S is configured to be constantly pressurized by all of the five pressure cylinders C1 to C5. As a result, in order to operate the five pressure cylinders C1 to C5 at the same speed, a large amount of hydraulic oil is required to be supplied thereto using large pumps, leading to excessive energy consumption. Also, a large number of the pressure cylinders also enlarges the sum of the sectional areas of the pressure cylinders and is accordingly disadvantageous in terms of control accuracy of the forging load as will be explained hereinafter.

FIG. 7 are a set of illustrations showing a relationship between the number of the pressure cylinders and the generating force. Specifically, FIG. 7(*a*) shows a case of one pressure cylinder, and FIG. 7(*b*) shows a case of three pressure cylinders. As shown in FIG. 7(*a*), the pressure cylinder C produces force by compressing the hydraulic oil within the cylinder. When K denotes the bulk modulus of the hydraulic oil, A denotes a pressure receiving area of the pressure cylinder C, and L denotes an initial height of the hydraulic oil within the pressure cylinder C, then a spring constant of the hydraulic oil is expressed by $Ko=\kappa\cdot A/L$. If the hydraulic oil flows into the pressure cylinder C by $\Delta x$, a force F produced is expressed by $F=Ko\times\Delta x=\kappa\cdot A\cdot\Delta x/L$. In other words, in order to produce the force F using the one pressure cylinder C, the hydraulic oil must be compressed by $\Delta x$.

As shown in FIG. 7(*b*), when three pressure cylinders C1 to C3 are used at the same time, the hydraulic oil within each of the pressure cylinders C1 to C3 must be compressed by $\Delta x/3$ to produce the same force F. In other words, the amount of compression of the hydraulic oil is reduced to one third (⅓) as compared with the case in which the force F is controlled by one pressure cylinder C as shown in FIG. 7(*a*). In other words, because the amount to be controlled is reduced down to one third (⅓), a large pump for controlling a flow rate of the hydraulic oil must have an increased controlling resolution that is three times higher than in the case of one pressure cylinder C. Likewise, when five pressure cylinders are used at the same time, the controlling resolution of the pump must be increased to a level five times higher than that of the pump when one pressure cylinder is used. For this reason, in general, a large forging press for using a plurality of pressure cylinders has a limited minimum forging load about 10% of a maximum load.

A large hydraulic forging press as disclosed in Patent Literature Document 1 includes a combination of large capacity cylinders (large diameter cylinders) and small capacity cylinders as the cylinders for exerting pressures on the slide. This hydraulic system is characterized by differently using the pressure cylinders upon dividing one cycle of forging into six processes from beginning to end, i.e., from "high speed downward movement" to "low power pressurized downward movement (low forging load)" to "medium power pressurized downward movement (medium forging load)" to "high power pressurized downward movement (high forging load)" to "depressurization" and to "upward movement."

In the high speed downward movement (no load) process, only the small capacity cylinders are supplied with the hydraulic oil to move the slide downward. This process makes it possible to obtain the same speed at a lesser flow rate than when the hydraulic is supplied to all of the cylinders, thus making it possible to reduce the size of the pumps, prefill valves and the like. Also, in the low power pressurized downward movement (low forging load) process, because the forging load is low and the pressing speed is high, the hydraulic oil is supplied to only the small capacity cylinders and a subsequent pressurization is carried out by only the small capacity cylinders. In the medium power pressurized downward movement (medium forging load) process, upon supplying the hydraulic oil to the small capacity cylinders and the large capacity cylinders on the head sides thereof, hydraulic oil within the large capacity cylinders on the rod sides thereof is brought back to the head sides thereof for use as a regenerative pressure circuit, thereby producing a medium power load. This working pressure circuit also acts to increase a lowering speed.

Further, in the high power pressurized downward movement (high forging load) process, the hydraulic oil is supplied from the pumps to the small capacity cylinders and the large capacity cylinders on the head sides thereof, and the pressures on the head sides are all used for the forging with the rod sides of all the cylinders being opened. In the depressurization process, the hydraulic oils on the head sides of all the cylinders are brought back to the tank to reduce the pressures of the head sides to zero. In the upward movement process, the hydraulic oil is supplied to only the rod sides of the small capacity cylinders, and the hydraulic oils on the head sides of the small capacity cylinders are brought back to the tank. Also, the hydraulic oil on the head sides of the large capacity cylinders flows into the rod sides so as to assist the upward movement, and the hydraulic oil on the head sides returns to the prefill tank.

The above-mentioned series of states during forging, that is, from "high-speed downward movement" to "low-power pressurized downward movement (low forging load)" to "medium-power pressurized downward movement (medium forging load)" to "high-power pressurized downward movement (high forging load)" to "depressurization" and to "upward movement", are switched by changing the states of excitation of solenoid valves with time in such a manner as indicated in a control table showing a series of movements of a press slide and the states of excitation of the solenoid valves at that moment, as illustrated in FIG. 4 of Patent Literature Document 1.

A large hydraulic forging press as disclosed in Patent Literature Document 2 is no more than a hydraulic system that automatically switches working processes as disclosed in Patent Literature Document 1 depending on the forging load. Here, "a pressure cylinder as a switching source which is supplied with a hydraulic oil" as described in Patent Literature Document 2 corresponds to "a small capacity cylinder" as described in Patent Literature Document 1, and "pressure cylinders switching destinations that form a combination for increasing a forging load capacity" as described in Patent Literature Document 2 correspond to "a combination of small capacity cylinders and large capacity cylinders" as described in Patent Literature Document 1.

LISTING OF REFERENCES

Patent Literature Documents

PATENT LITERATURE DOCUMENT 1: Japanese Utility Model Registration No. 2575625 B

PATENT LITERATURE DOCUMENT 2: Japanese Patent No. 5461206 B

SUMMARY OF THE INVENTION

Problems to be Solved by the Invention

In Patent Literature Document 2, when the pressure cylinders to be used are switched from "the pressure cylinder as a switching source which is supplied with the hydraulic oil" to "the pressure cylinders as switching destinations that form a combination for increasing the forging load capacity," a depressurization valve connected to "the pressure cylinder as a switching source which is supplied with the hydraulic oil" is opened immediately before an oil pressure within "the pressure cylinder in use as the switching source" becomes negative. This means that the pressure of the pressure cylinder used when the forging load is small is once reduced to zero when the pressure cylinder is switched to a combination of different cylinders. Accordingly, as shown in FIG. 3(A) of Patent Literature Document 2, surging of the forging load is generated or a dead zone where the forging speed becomes zero is generated.

Patent Literature Document 2 has proposed that, in order to reduce such dead zones even if only slightly, the pressure cylinder in use as the switching source and the pressure cylinders to be used as the switching destinations are connected to one another via communication valves so that they may be supplied with a pressurized oil from a pump by opening the communication valves at the time of switching, and at the same time, the pressure cylinders to be used as the switching destinations may be also supplied with a pressurized oil from the pressure cylinder having certain pressure as the switching source. However, the dead zones cannot be completely eliminated as shown in FIG. 3(B) of Patent Literature Document 2.

The present invention has been made in view of the above-described circumstances and intends to provide a hydraulic forging press that is capable of suppressing the surging of the forging load or the dead zone where the forging speed becomes zero and also capable of highly accurately forging over a wider range than in the prior art from a low load to a high load. The present invention also intends to provide a method of controlling such a hydraulic forging press.

Solution to the Problems

According to one aspect of the present invention, there is provided a hydraulic forging press including a plurality of pressure cylinders. The pressure cylinders have a main pressure cylinder configured to be capable of constantly supplying hydraulic oil during forging; and at least one or more secondary pressure cylinders configured to be capable of switching a supply and a supply stop of the hydraulic oil depending on a forging load. Head side hydraulic chambers of the secondary pressure cylinders are connected to a head side hydraulic chamber of the main pressure cylinder through switching valves, respectively. In the hydraulic forging press, the main pressure cylinder is solely used until the forging load exceeds a predetermined set load, and the number of the secondary pressure cylinders to be used is gradually increased as the forging load increases after the forging load exceeds the set load.

According to another aspect of the present invention, there is provided a method of controlling a hydraulic forging press having a plurality of pressure cylinders. The pressure cylinders include a main pressure cylinder configured to be capable of constantly supplying hydraulic oil during forging; and at least one or more secondary pressure cylinders configured to be capable of switching a supply and a supply stop of the hydraulic oil depending on a forging load. The method of controlling the hydraulic forging press includes automatically increasing the number of pressure cylinders to be used by a sequence of supplying the main pressure cylinder with the hydraulic oil, also supplying at least one of the secondary pressure cylinders with the hydraulic oil before the forging load of the main pressure cylinder in use exceeds the prescribed set load, and also further supplying at least one of different secondary pressure cylinders with the hydraulic oil before the forging load of the pressure cylinders in use exceeds the prescribed set load; and, when adding the secondary pressure cylinders, changing a control gain of a pressing speed control system depending on a sum of sectional areas of the pressure cylinders proportional to the number of the pressure cylinders to be used.

Advantageous Effects of the Invention

According to the hydraulic forging press and the method of controlling the same of the present invention, only the main pressure cylinder is used until the forging load exceeds a predetermined set load, and after the forging load exceeds the set load, the number of the secondary pressure cylinders to be used is gradually increased as the forging load increases. By doing so, a change in number of the pressure cylinders to be used can be continuously performed without reducing the forces of the pressure cylinders to zero, as described in Patent Literature Document 2. In other words, surging of the forging load or generation of the dead zone where the forging speed becomes zero can be suppressed by gradually increasing the number of the pressure cylinders to be used, but not increasing the number of cylinders by switching the pressure cylinders as in the prior art.

Also, because the forging can be performed using only the main pressure cylinder, the hydraulic forging press according to the present invention can be applicable not only to forging at an extremely low load (about 1% of the maximum load) but also to forging at a desired maximum load by increasing the number of the secondary pressure cylinders. Thus, it makes it possible to achieve highly accurate forging over a wider range than ever before from the extremely low load (about 1% of the maximum load) to the maximum load.

MODE FOR CARRYING OUT THE INVENTION

Figure 1:
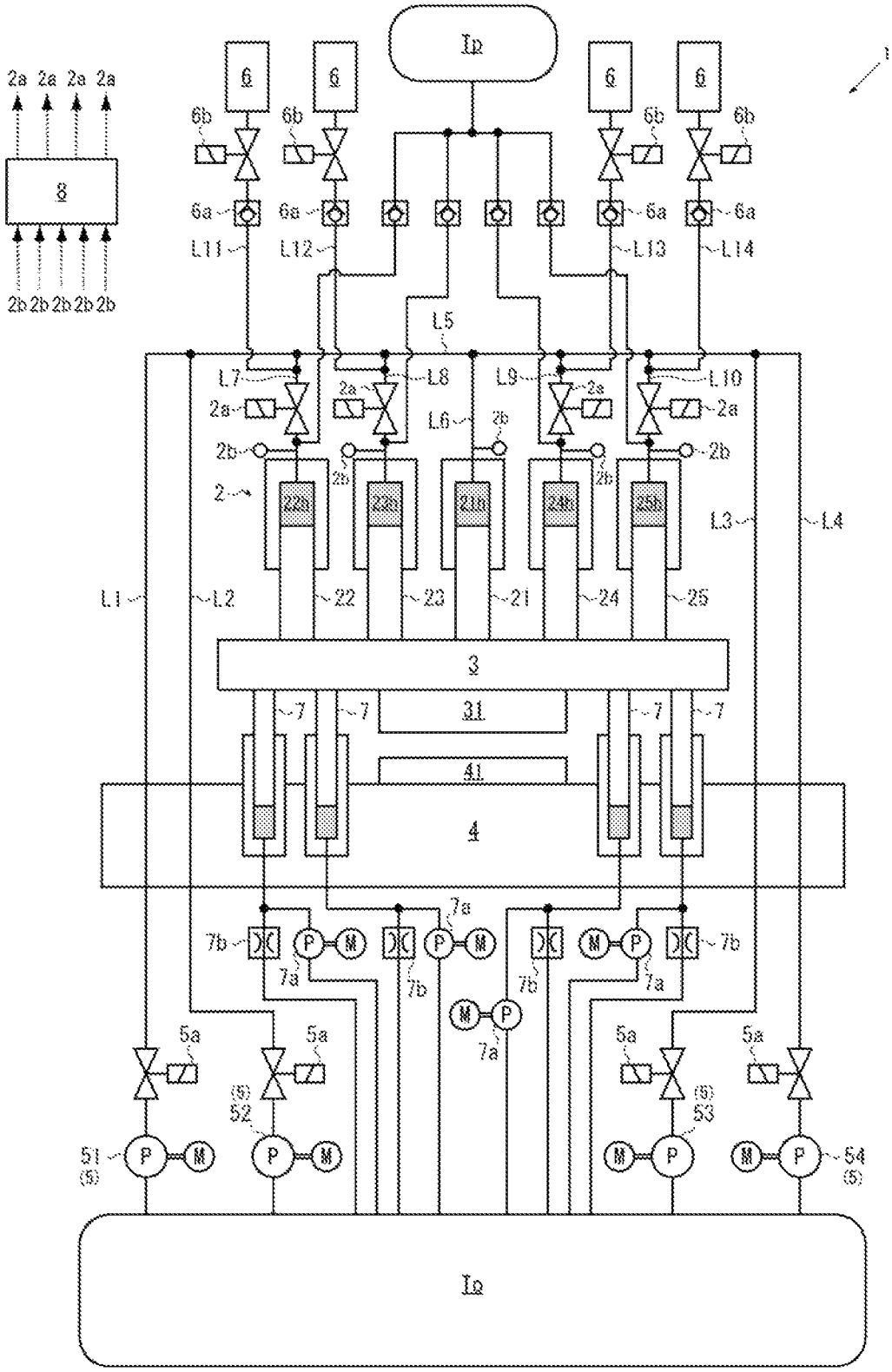
FIG. 1 is an overall block diagram showing a hydraulic forging press according to a basic embodiment of the present invention.
Figure 2:
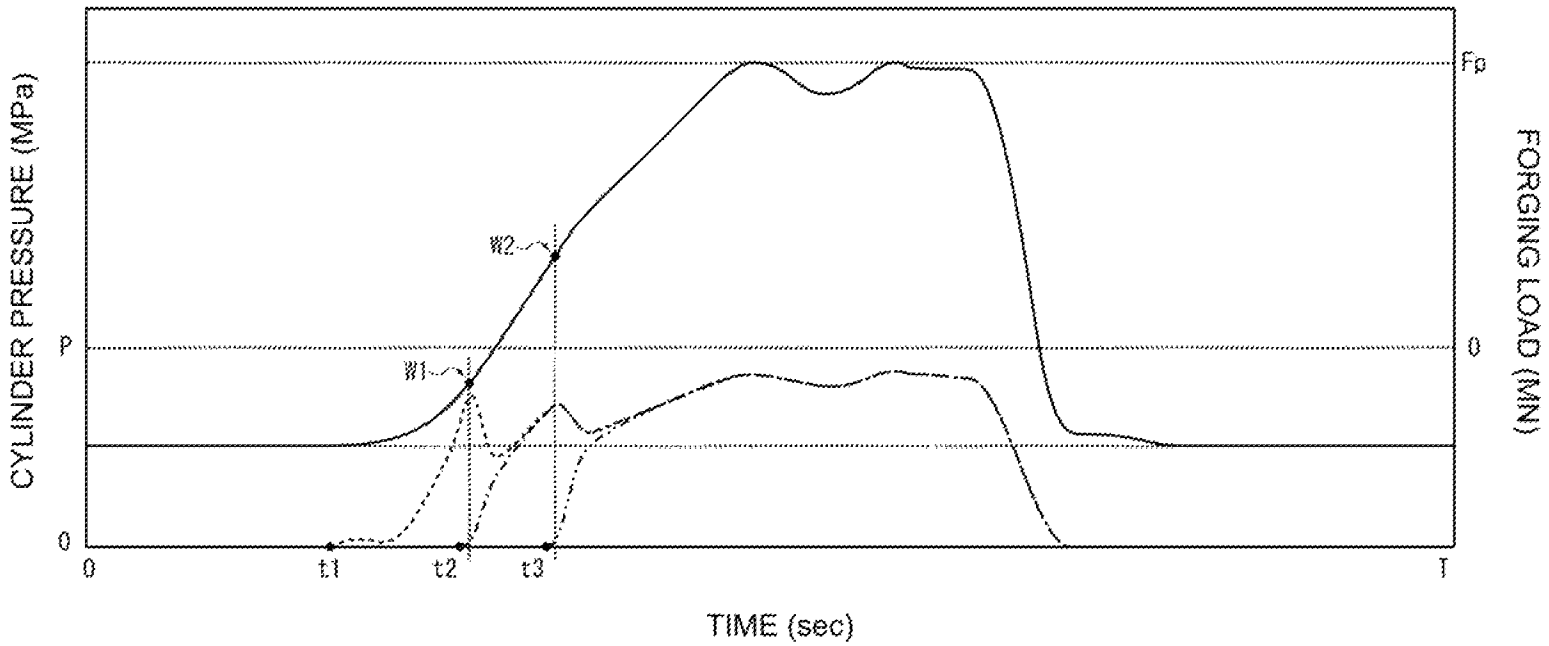
FIG. 2 is an illustration showing a relationship between a cylinder pressure and a forging load of the hydraulic forging press shown in FIG. 1.

An embodiment of the present invention is explained hereinafter with reference to FIG. 1 to FIG. 5. Here, FIG. 1 is an overall block diagram showing a hydraulic forging press according to a basic embodiment of the present invention. FIG. 2 is an illustration showing a relationship between a cylinder pressure and a forging load of the hydraulic forging press shown in FIG. 1.

As shown in FIG. 1, the hydraulic forging press 1 according to the basic embodiment of the present invention includes a plurality of pressure cylinders (hereinafter referred to as a "pressure cylinder group 2"). The pressure cylinder group 2 has a main pressure cylinder 21 configured to constantly supply hydraulic oil during forging and a plurality of secondary pressure cylinders 22 to 25 configured to switch a supply and a supply stop of the hydraulic oil depending on a forging load. The hydraulic forging press 1 is characterized in that only the main pressure cylinder 21 is used until the forging load exceeds a predetermined set load, and after the forging load exceeds the set load, the number of the secondary pressure cylinders 22 to 25 to be used is automatically gradually increased as the forging load increases.

The hydraulic forging press 1 includes a slide 3 having an upper die 31, a bed 4 having a lower die 41, a plurality of pumps 5 for supplying the pressure cylinder group 2 with the hydraulic oil, a prefill tank Tp for supplementarily supplying the secondary pressure cylinders 22 to 25 with the hydraulic oil, and an oil tank To for storing the hydraulic oil therein. The prefill tank Tp is filled with the hydraulic oil having pressure close to zero to supply the secondary pressure cylinders 22 to 25 not in use during forging with the hydraulic oil in response to a vertical movement of the slide 3 and to receive the hydraulic oil discharged from the secondary pressure cylinders 22 to 25.

The hydraulic forging press 1 may also include a plurality of auxiliary accumulators 6. When at least one of the secondary pressure cylinders 22 to 25 are added to the main pressure cylinder 21, the auxiliary accumulators 6 act to supply, if the forging speed is high, the secondary pressure cylinders 22 to 25 with a pressurized hydraulic oil to assist supply of hydraulic oils from the pumps 5, thereby expediting establishment of the pressures, respectively. The auxiliary accumulators 6 are not consistently used depending on the forging conditions. Also, the slide 3 has a plurality of support cylinders 7 for supporting the slide 3. It should be noted here that structures such as, for example, a crown and a frame for supporting the pressure cylinders 2 are not shown.

The pumps 5 include, for example, four large hydraulic pumps (that is, a first pump 51, a second pump 52, a third pump 53, and a fourth pump 54), and each of the pumps 5 is connected to the oil tank To. In operation, the first pump 51 is configured to supply the pressure cylinder group 2 with the hydraulic oil from the oil tank To via a first supply line L1. Likewise, the second pump 52 is configured to supply the pressure cylinder group 2 with the hydraulic oil via a second supply line L2, the third pump 53 is configured to supply the pressure cylinder group 2 with the hydraulic oil via a third supply line L3, and the fourth pump 54 is configured to supply the pressure cylinder group 2 with the hydraulic oil via a fourth supply line L4.

The first to fourth supply lines L1 to L4 are provided with respective electromagnetic switching valves 5*a* connected thereto, and the number of the pumps 5 to be used can be controlled by controlling opening and closing of those electromagnetic switching valves 5*a*. Accordingly, the pressure cylinder group 2 (that is, the main pressure cylinder 21 and the secondary pressure cylinders 22 to 25) is connected to the plurality of pumps 5 (the first to fourth pumps 51 to 54) for supplying the hydraulic oil, and the number of the pumps 5 to be used can be changed during forging depending on the number of the cylinders of the pressure cylinder group 2 in use and the necessary pressing speed. It should be noted here that the number of the pumps 5 is not limited to four, and it is needless to say that two or more pumps may be installed.

The first to fourth supply lines L1 to L4 join together in the midpoint to form a common supply line L5. The common supply line L5 is connected to branch supply lines L6 to L10 to supply the pressure cylinder group 2 (that is, the main pressure cylinder 21 and the secondary pressure cylinders 22 to 25) with the hydraulic oil, respectively.

The branch supply lines L7 to L10 connected respectively to the secondary pressure cylinders 22 to 25 are provided with respective electromagnetic switching valves 2*a* and respective pressure gauges 2*b* attached thereto. These branch supply lines L7 to L10 are respectively connected to auxiliary supply lines L11 to L14 that is capable of supplementarily supplying the secondary pressure cylinders 22 to 25 with the hydraulic oil at the same time as the supply of hydraulic oils from the pumps 5. The auxiliary supply lines L11 to L14 are connected to respective auxiliary accumulators 6 via respective check valves 6*a* and respective electromagnetic switching valves 6*b*. In other words, the secondary pressure cylinders 22 to 25 are connected at their head side hydraulic chambers 22*h* to 25*h* to the auxiliary accumulators 6 so that the hydraulic oil can be supplied from the auxiliary accumulators 6 to the head side hydraulic chambers 22*h* to 25*h* at the time of pressurization by the secondary pressure cylinders 22 to 25.

According to the illustrated hydraulic circuit, the main pressure cylinder 21 and the secondary pressure cylinders 22 to 25 are connected together so as to flow the hydraulic oil via the branch supply line L6, the common supply line L5 and the branch supply lines L7 to L10. That is, the secondary pressure cylinders 22 to 25 are connected at their head side hydraulic chambers 22*h* to 25*h* to a head side hydraulic chamber 21*h* of the main pressure cylinder 21 via the electromagnetic switching valves 2*a*.

As shown in the drawings, the pressure cylinder group 2 includes one main pressure cylinder 21 and four secondary pressure cylinders 22 to 25. It should be noted that the number of the secondary pressure cylinders is not limited to four, and it is sufficient if at least one secondary pressure cylinder is provided, and hence, two, three or five or more secondary pressure cylinders may be provided. Also, the main pressure cylinder 21 and the secondary pressure cylinders 22 to 25 can be arbitrarily disposed, and any possible arrangement may be employed as long as forces can be uniformly exerted on the slide 3.

In this embodiment, a forging load that can be exerted by only one pressure cylinder (that is, the main pressure cylinder 21) out of the pressure cylinder group 2 is referred to as a "low load," a forging load that can be exerted by three pressure cylinders (that is, the main pressure cylinder 21 and the secondary pressure cylinders 22 and 23) out of the pressure cylinder group 2 is referred to as a "medium load," and a forging load that can be exerted by five pressure cylinders (that is, the main pressure cylinder 21 and the secondary pressure cylinders 22 to 25) out of the pressure cylinder group 2 is referred to as a "high load." By way of example, in the case in which each of the pressure cylinders of the pressure cylinder group 2 (the main pressure cylinder 21 and the secondary pressure cylinders 22 to 25) has a maximum forging load capacity of ten thousand tons, a forging load up to ten thousand tons is referred to as the "low load," a forging load ranging from ten thousand tons to thirty thousand tons is referred to as the "medium load," and a forging load ranging from thirty thousand tons to fifty thousand tons is referred to as the "high load."

In this embodiment, a forging load of about 1% of the maximum load (for example, fifty thousand tons) is in particular referred to as an "extremely low load," and in this embodiment, the forging load can be highly accurately controlled over a wide range from this extremely low load to the maximum load. The operation of the hydraulic forging press 1 shown in FIG. 1 is explained hereinafter with reference to FIG. 1 and FIG. 2.

An explanation will be made hereinafter as to a case in which the forging load is a low load when the forging load changes in such a manner as a "low load" to a "medium load" and to a "high load." If the forging load is a low load, only the main pressure cylinder 21 is used, and hence, the electromagnetic switching valves 2*a* disposed in the branch supply lines L7 to L10 are all closed. At this time, the electromagnetic switching valves 5*a* disposed in the first supply line L1, the second supply line L2, the third supply line L3, and the fourth supply line L4 are all opened. Also, the electromagnetic switching valves 6*b* disposed in the auxiliary supply lines L11 to L14 are all closed.

Accordingly, the hydraulic oil supplied from the first to fourth pumps 51 to 54 are supplied to the main pressure cylinder 21 via the first supply line L1 and the second supply line L2 and then via the common supply line L5 and the branch supply line L6, and the cylinder pressure begins to rise at a time t1 shown in FIG. 2. In this way, the hydraulic oil from all the pumps 5 is supplied to the main pressure cylinder 21 for use of only the main pressure cylinder 21, thus, it makes it possible to carry out the low load forging while moving the slide 3 downward at a high speed.

The pressure of the main pressure cylinder 21 is measured by the pressure gauge 2*b* disposed in the branch supply line L6, and a signal therefrom is momentarily transmitted to a controller (not shown), which in turn calculates a to-be-applied load by multiplying a measured value by a cylinder sectional area.

Next, a case in which the forging load is shifted from a low load to a medium load will be explained. The main pressure cylinder 21 has a predetermined set load W1 (see FIG. 2), and immediately before an applied force exerted by the main pressure cylinder 21 exceeds the set load W1 (at a time t2 in FIG. 2), the hydraulic oil is supplied to two secondary pressure cylinders 22 and 23 to increase the pressures of the two secondary pressure cylinders 22 and 23. More specifically, the hydraulic oil is supplied from the common supply line L5 to the secondary pressure cylinders 22 and 23 by switching the electromagnetic switching valves 2*a* disposed in the branch supply lines L7 and L8 from a closed state to an open state.

Because the main pressure cylinder 21 is also connected to the common supply line L5, the main pressure cylinder 21 and the secondary pressure cylinders 22 and 23 seek to have the same pressure based on Pascal's principle. Accordingly, the pressure of the main pressure cylinder 21 is reduced, and the pressures of the secondary pressure cylinders 22 and 23 increase. As just described above, in this embodiment, a mere addition of the secondary pressure cylinders 22 and 23 automatically controls the pressures. As a result, as shown in FIG. 2 the surging of the forging load, which has been hitherto caused by the addition of the cylinders as disclosed in Patent Literature Document 2, or the dead zone where the forging speed becomes zero are not generated.

When the forging speed is high, in order to promptly bring the pressures of the secondary pressure cylinders 22 and 23 close to a target value, the electromagnetic switching valves 6*b* disposed in the auxiliary supply lines L11 and L12 are changed from the closed state to the open state to supply hydraulic oil from the auxiliary accumulators 6 to the secondary pressure cylinders 22 and 23 so as to assist a rapid establishment of the pressures.

Although the case of the addition of the secondary pressure cylinders 22 and 23 is explained herein, it should be noted that the present invention is not limited to the above-described combination, and it is needless to say that arbitrary two pressure cylinders may be selected from among the secondary pressure cylinders 22 to 25 for addition, or only one pressure cylinder may be added.

Because the forging speed becomes slow as the forging load increases, the number of the pumps 5 to be used can be gradually reduced. The hydraulic oil supplied from the third pump 53 to the common supply line L5 via the third supply line L3 can be stopped by switching the electromagnetic switching valve 5*a* disposed in the third supply line L3 from the open state to the closed state.

An individual pressure of each of the main pressure cylinder 21 and the secondary pressure cylinders 22 and 23 is measured by the pressure gauges 2*b* disposed in the branch supply lines L6 to L8, and a signal therefrom is momentarily transmitted to a cylinder select control device 8. An individual applied load exerted is then calculated by multiplying each of measured values by associated cylinder sectional area, and upon calculation of the sum of all of the applied load, a total applied load exerted by the pressure cylinder group 2 in use can be calculated.

Next, a case in which the forging load is shifted from a medium load to a high load will be explained. When the number of the to-be-used cylinders of the pressure cylinder group 2 is three (that is, the main pressure cylinder 21 and the secondary pressure cylinders 22 and 23), a predetermined set load W2 (see FIG. 2) is set, and immediately before an applied load exerted by the pressure cylinder group 2 (that is, the sum of the applied load of the main pressure cylinder 21 and the secondary pressure cylinders 22 and 23) exceeds the set load W2 (at a time t3 in FIG. 2), the hydraulic oil is supplied to the secondary pressure cylinders 24 and 25 to further increase the pressures of the secondary pressure cylinders 24 and 25. More specifically, the hydraulic oil is supplied from the common supply line L5 to the secondary pressure cylinders 24 and 25 by switching the electromagnetic switching valves 2*a* disposed in the branch supply lines L9 and L10 from a closed state to an open state.

At this moment, the main pressure cylinder 21, the secondary pressure cylinders 22 and 23, and the newly added secondary pressure cylinders 24 and 25 are all used and seek to have the same pressure on Pascal's principle, as described above. Accordingly, the pressure of the main pressure cylinder 21 and the pressures of the secondary pressure cylinders 22 and 23 reduce, and the pressures of the secondary pressure cylinders 24 and 25 increase. For this reason, as shown in FIG. 2, surging of the forging load, which has been hitherto caused by the addition of the cylinders as disclosed in Patent Literature Document 2, or dead zones where the forging speed becomes zero are not generated.

When the forging speed is high, in order to promptly bring the pressures of the secondary pressure cylinders 24 and 25 close to a target value, the electromagnetic switching valves 6*b* disposed in the auxiliary supply lines L13 and L14 are switched from the closed state to the open state to supply hydraulic oils from the auxiliary accumulators 6 to the secondary pressure cylinders 24 and 25 so as to assist rapid establishment of the pressures.

Although the case of the eventual addition of the secondary pressure cylinders 24 and 25 is explained herein, it should be noted that the present invention is not limited to the above-mentioned combination, and the combination is changed as appropriate depending on the previously added secondary pressure cylinder(s). Also, as described above, because the forging speed reduces as the forging load increases, it is needless to say that the number of the pumps 5 in use can be gradually reduced.

The pressure of each of the main pressure cylinder 21 and the secondary pressure cylinders 22 to 25 is measured by associated one of the pressure gauges 2*b* disposed in the branch supply lines L6 to L10, and a signal therefrom is momentarily transmitted to the cylinder select control device 8. An individual applied load exerted is then calculated by multiplying each of the measured values by associated cylinder sectional area, and upon calculation of the sum of all of the applied loads, a total applied load exerted by the pressure cylinder group 2 in use can be calculated.

Accordingly, by measuring the cylinder pressures of the pressure cylinder group 2 in use and by causing the cylinder select control device 8 to control opening and closing of the electromagnetic switching valves 2*a* connected to the pressure cylinder group 2, supply of the hydraulic oil to the pressure cylinder group 2 can be controlled in such a manner that the forging load is gradually increased up to the maximum load, and the maximum load is then maintained for a given length of time, as shown in, for example, FIG. 2.

Although in the above-described embodiment the case in which the secondary pressure cylinders 22 to 25 are increased by two at a time is explained, the secondary pressure cylinders 22 to 25 may be increased by one at a time, or the secondary pressure cylinders 22 to 25 may be increased by any other arbitrary combination. By way of example, the number of the secondary pressure cylinders 22 to 25 to be used may be increased in such a manner as from one to three to four to five, from one to two to four to five, or one to three to four to five. In other words, the secondary pressure cylinders 22 to 25 are configured so as to be increased by one at a time or by two or more at a time.

In the above-described embodiment, an explanation has been made as to the case in which the set loads W1 and W2 are set depending on the use of one pressure cylinder and the use of three pressure cylinders, respectively, and the number of the secondary pressure cylinders 22 to 25 to be used is increased before an applied load exerted by the pressure cylinder group 2 exceeds the set load W1 or W2 (at the time t2 or t3). Nevertheless, it should be noted that the present invention is not limited to such a case. By way of example, if the number of the to-be-used cylinders of the pressure cylinder group 2 is increased by one at a time, a set load for the use of one pressure cylinder (only the main pressure cylinder 21), another set load for the use of two pressure cylinders (the main pressure cylinder 21 and the secondary pressure cylinder 22), a further set load for the use of three pressure cylinders (the main pressure cylinder 21 and the secondary pressure cylinders 22 and 23), and a still further set load for the use of four pressure cylinders (the main pressure cylinder 21 and the secondary pressure cylinders 22 to 24) are se.

In the above-described embodiment, the number of the pumps 5 to be used to supply the pressure cylinder group 2 with the hydraulic oil can be changed depending on the number of the cylinders of the pressure cylinder group 2 in use and the necessary pressing speed.

Here, FIG. 2 will be explained hereinafter in detail. FIG. 2 is a measurement chart showing a change in cylinder pressure and a change in forging load, when the number of the cylinders of the pressure cylinder group 2 has been automatically increased in such a manner as from one to three to five during forging with the use of the hydraulic forging press 1 shown in FIG. 1. A horizontal axis indicates the time T (sec), a left side vertical axis indicates the cylinder pressure P (MPa), and a right side vertical axis indicates the forging load Fp (MN). Also, a solid line indicates the forging load, a chain line indicates the cylinder pressure produced by one pressure cylinder, a single-dotted chain line indicates the cylinder pressure produced by three pressure cylinders, and a double-dotted chain line indicates the cylinder pressure produced by five pressure cylinders.

As shown in FIG. 2, when the low load is switched to the medium load, the pressure of the main pressure cylinder 21 is reduced immediately before reaching a value corresponding to the set load W1, and the pressures of the secondary pressure cylinders 22 and 23 begin to increase. The reason for this is that hydraulic oil flows into the secondary pressure cylinders 22 and 23 from the pumps 5 and the main pressure cylinder 21 at the same time. When the pressure of the main pressure cylinder 21 becomes equal to the pressures of the secondary pressure cylinders 22 and 23, the flow of the hydraulic oil from the main pressure cylinder 21 into the secondary pressure cylinders 22 and 23 is stopped, and the amount of hydraulic oil within the three cylinders (that is, the main pressure cylinder 21 and the secondary pressure cylinders 22 and 23) of the pressure cylinder group 2 is controlled by the amount of hydraulic oil discharged from the pumps 5.

In a similar manner, when the medium load is switched to the high load, the total pressure of the three pressure cylinders of the pressure cylinder group 2 is reduced immediately before reaching a value corresponding to the set load W2, and the pressures of the secondary pressure cylinders 24 and 25 begin to increase. The reason for this is that hydraulic oil flows into the secondary pressure cylinders 24 and 25 from the pumps 5 and the three pressure cylinders of the pressure cylinder group 2 in use at the same time. When the pressure of the main pressure cylinder 21 becomes equal to the pressures of the secondary pressure cylinders 22 to 25, the flow of the hydraulic oil from the pressure cylinders of the pressure cylinder group 2 in use into the secondary pressure cylinders 24 and 25 is stopped, and the amount of hydraulic oil within the five cylinders (that is, the main pressure cylinder 21 and the secondary pressure cylinders 22 to 25) of the pressure cylinder group 2 is controlled by the amount of the hydraulic oil discharged from the pumps 5.

As just described above, according to this embodiment, because the number of the pressure cylinders of the pressure cylinder group 2 is continuously and smoothly increased or added, the dead zone of the forging speed as disclosed in Patent Literature Document 2, in which "switching" of the pressure cylinders is conducted instead of "addition", a reduction in forging load or the like does not occur, and as shown in FIG. 2, a rise in forging load also becomes continuously smooth. The reason why the forging load is reduced temporarily and increases again after the maximum load has been reached is that the forging load is intentionally controlled in the above-described manner.

Figure 6:
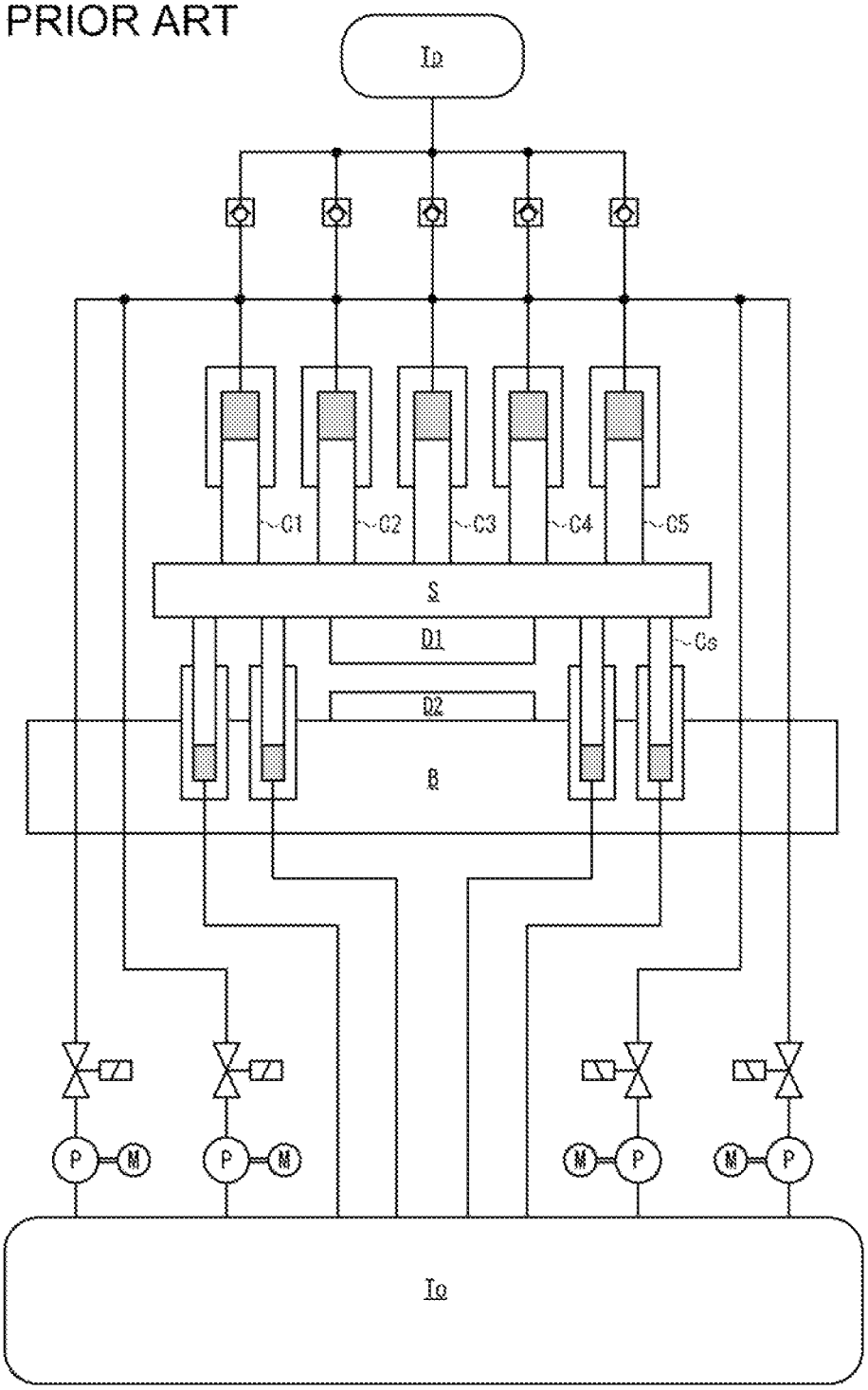
FIG.6 PRIOR ART
FIG. 6 is an overall block diagram showing an example of a conventional large hydraulic forging press.
Figure 7A:
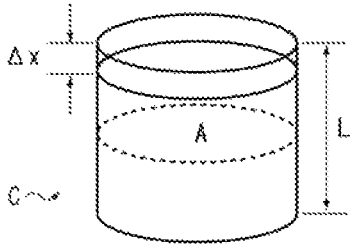
FIGS. 7(*a*) and 7(*b*) are a set of illustrations showing a relationship between the number of pressure cylinders and a pressing force. Specifically, FIG. 7(*a*) shows a case of one pressure cylinder, and FIG. 7(*b*) shows a case of three pressure cylinders.
Figure 7B:
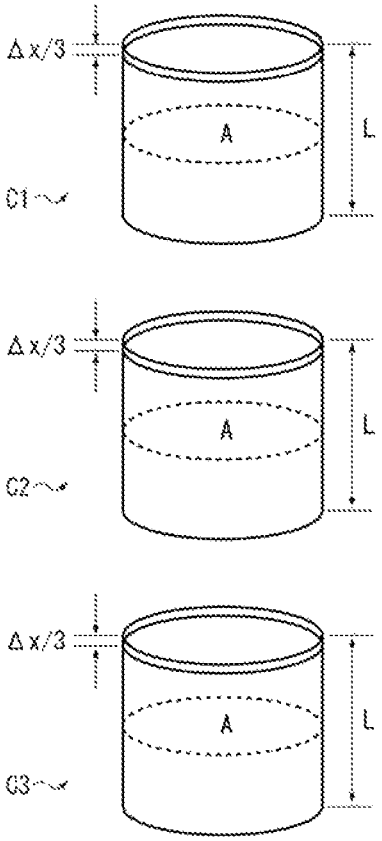

The hydraulic forging press 1 according to this embodiment is a large hydraulic forging press that is capable of producing a forging load as large as, for example, fifty thousand tons. Nevertheless, the hydraulic forging press 1 can conduct accurate forging even if the forging load is a low load. In contrast, because a conventional large hydraulic forging press uses pressure cylinders C1 to C5 from the beginning, as shown in FIG. 6, the amount of the hydraulic oil to be controlled becomes small in a low load region, and hence, a substantial control is not possible.

On the other hand, because the hydraulic forging press 1 according to this embodiment uses only one pressure cylinder (the main pressure cylinder 21) in the low load region, a given amount of hydraulic oil can be maintained as an amount of hydraulic oil to be controlled, thus enabling a sufficient control. As a result, the amount of hydraulic oil can be controlled even in an extremely low load region where the forging load is as small as about 1% of the maximum load (for example, fifty thousand tons).

The control accuracy of the pumps 5 and a forging load control will be explained hereinafter. In general, a large pump used in a large hydraulic forging press usually has hysteresis of about 2%. In other words, this means that an extremely small amount as small as 2% cannot be basically controlled. In a case of a hydraulic forging press that produces a maximum forging load of fifty thousand tons at a maximum working pressure of, for example, 450 kgf/cm$^2$, when converting into the forging load, 2% of the maximum forging load corresponds to a thousand tons. In other words, the conventional hydraulic forging press can obtain accuracy only in the order of several thousand tons at most.

On the other hand, the hydraulic forging press 1 according to this embodiment uses only one pressure cylinder at first, and a maximum load in the low load region is accordingly ten thousand tons, i.e., one fifth of the maximum forging load. 2% of this load corresponds to a load of two hundred tons, and hence, the forging load can be controlled in the order of several hundred tons. In other words, because the large hydraulic forging press 1 having a maximum load of fifty thousand tons can conduct forging of several hundred tons, accurate forging can be performed not only in the low load region but also in the extremely low load region (about five hundred tons). As a result, the hydraulic forging press 1 according to this embodiment can conduct accurate forging in a wide range from the extremely low load region to a high load region.

Also, the pumps 5 may be configured to be able to change a set pressure. By way of example, if the pumps 5 are first used at a set pressure of 35 MPa and the set pressure is subsequently changed from 35 MPa to 44 MPa when a high load is required with progress of the forging, the forging load can be increased by 1.26 fold. In other words, when four pumps 5 are used at a pressure of 35 MPa to exert a forging load of 78.5 MN (eight thousand ton weight), the forging load can be increased up to 98.3 MN (ten thousand ton weight) by increasing the set pressure of the four pumps 5 up to a maximum discharge pressure (for example, 44 MPa).

Accordingly, after a discharge pressure of the pumps 5 is set to a pressure less than a maximum value to start the forging and then all the pressure cylinders are then used with progress of the forging, the set pressure of the pumps 5 can be subsequently changed to the maximum value to further increase the forging load. Also, the set pressure of the pumps 5 may be changed every time the number of the cylinders of the pressure cylinder group 2 in use increases. By way of example, the pumps 5 may be configured in such a manner that the pumps 5 are first used at a low set pressure when only one pressure cylinder is used, the set pressure of the pumps 5 being then changed to a high set pressure (the maximum value) before reaching the set load W1, the set pressure of the pumps 5 being subsequently brought back to the low set pressure when the number of the pressure cylinders to be used is changed to three, and being further changed to the high set pressure (the maximum value) before reaching the set load W2, and the set pressure of the pumps 5 being brought back to the low set pressure again, when the number of the pressure cylinders to be used is changed to five.

As described above, by using the pumps 5 having a variable set pressure, the applied force of the pressure cylinder group 2 can be changed by changing the set pressure of the pumps 5. Although in the foregoing description the pumps 5 have been described as being switched between two set pressures, pumps 5 may have three or more different set pressures that are switchable thereamong.

Figure 3:
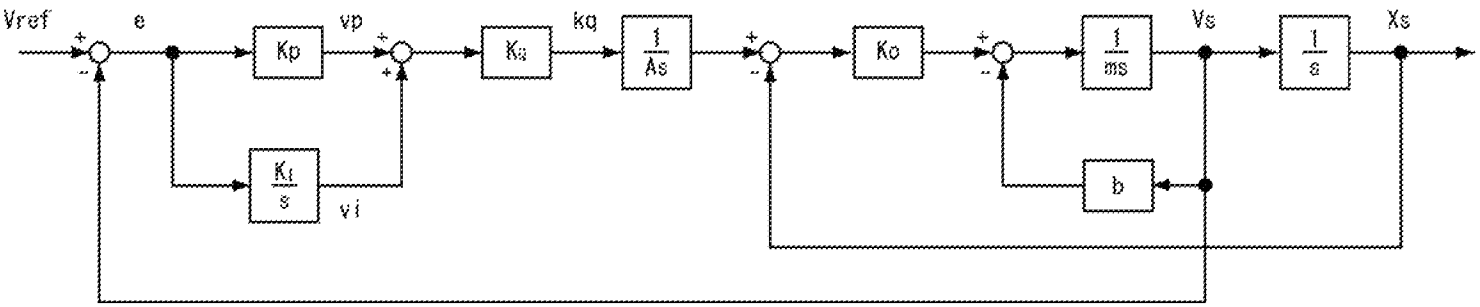
FIG. 3 is a block diagram showing the characteristics of a pressing speed control system of the hydraulic forging press shown in FIG. 1.
Figure 4A:
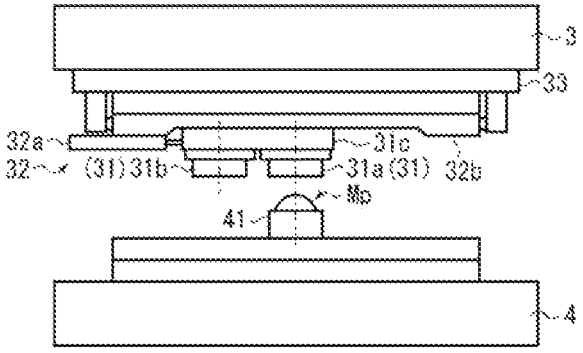
FIGS. 4(*a*) to 4(*d*) are a set of illustrations showing another embodiment of the hydraulic forging press shown in FIG. 1. Specifically, FIG. 4(*a*) shows a first stand-by process, FIG. 4(*b*) shows a first pressing process, FIG. 4(*c*) shows a second stand-by process, and FIG. 4(*d*) shows a second pressing process.
Figure 4B:
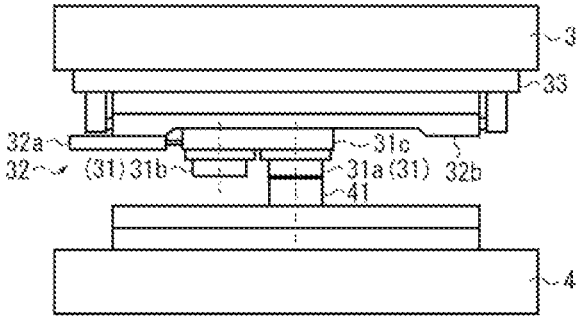
Figure 4C:
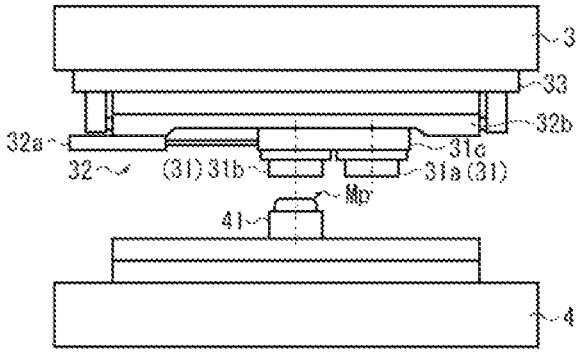
Figure 4D:
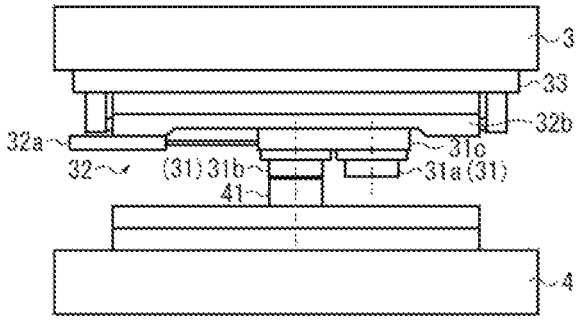

In the meantime, in the case in which hot forging is performed using a large hydraulic forging press, temperature controls of a material and dies are important, and an accurate control of the pressing speed of the slide 3, which directly affects the forging time, is also important. FIG. 3 is a block diagram showing the characteristics of a pressing speed control system of the hydraulic forging press shown in FIG. 1. It should be noted that, in FIG. 3, Vref denotes a set value of a slide speed, Vs denotes the slide speed, e denotes a deviation, Kp denotes a proportional control gain, $K_I$ denotes an integral control gain, s denotes a Laplace operator, vp denotes an amount of correction by a proportional control, vi denotes an amount of correction by an integral control, $K_Q$ denotes a pump flow gain, kq denotes a pump flow rate for correcting the deviation e, A denotes a sectional area of a pressure cylinder, Ko denotes a spring constant of the hydraulic oil (a spring constant of a hydraulic system taking into account a volume of a hydraulic oil within the pressure cylinder group 2 and that of hydraulic oils within pipes (the branch supply lines L6 to L10)), m denotes a mass of the slide 3, b denotes friction of a slide mechanical system, and Xs denotes a slide displacement.

The set value Vref of the slide speed is momentarily changed depending on the forging conditions. The set value Vref of the slide speed is compared with an actual slide speed Vs, and the deviation e therebetween is multiplied by the proportional control gain Kp to thereby obtain the amount of correction vp by the proportional control of a pressing speed control system. On the other hand, the deviation e of the slide speed is integrated and then multiplied by the integral control gain $K_I$ to thereby obtain the amount of correction vi by the integral control of the pressing speed control system. The sum of the amount of correction vp by the proportional control and the amount of correction vi by the integral control acts on the pump flow gain $K_Q$, and the pump flow rate kq for correcting the deviation e is eventually determined.

This flow rate kq acts on the pressure cylinder group 2 in use, and a hydraulic spring undergoes a deflection to produce a force. Resultantly, the slide 3 is accelerated and moved downward. The applied force produced by the pressure cylinder group 2 in use moves the slide 3 and creates a force to forge a material. It should be noted that the block diagram shown in FIG. 3 primarily intends to show or examine the characteristics of the pressing speed control system, and accordingly, does not take the characteristics of the material into consideration.

Formula 1 can be obtained by determining the slide speed Vs from the block diagram of FIG. 3.

$$Vs = \frac{K_Q \cdot K_O \cdot K_P \cdot s + K_Q \cdot K_O \cdot K_I}{A \cdot m \cdot s^3 + A \cdot b \cdot s^2 + (A \cdot K_O + K_Q \cdot K_O \cdot K_P)s + K_Q \cdot K_O \cdot K_I} Vref \quad \text{[Formula 1]}$$

Assuming that the integral control gain is $K_I$=0, Formula 2 can be obtained.

$$Vs = \frac{K_Q \cdot K_O \cdot K_P}{A \cdot m \cdot s^2 + A \cdot b \cdot s + A \cdot K_O + K_Q \cdot K_O \cdot K_P} Vref \quad \text{[Formula 2]}$$

When a step input is applied to the set value Vref of the slide speed, the slide speed Vs eventually reaches a value represented by Formula 3 by making the time t go to infinity (t to ∞), i.e., by making s go to zero (s to 0) using the final value theorem generally known in control theory, and hence, the slide speed Vs does not match the set value Vref $$Vs = \frac{K_Q \cdot K_O \cdot K_P}{A \cdot K_O + K_Q \cdot K_O \cdot K_P} Vref \quad \text{[Formula 3]}$$

Because $K_Q$·Ko·Kp<A·Ko+$K_Q$·Ko·Kp, i.e., a right side first term<1, the slide speed Vs reaches only a value less than the set value Vref at most. That is, in this control system, the proportional control turns out not to be able to control the pressing speed. When the proportional control gain is Kp=0, Formula 4 can be obtained from Formula 1. Because in Formula 4 a denominator contains all of third-order, second-order, first-order and zero-order terms of s, the slide speed is stable.

$$Vs = \frac{K_Q \cdot K_O \cdot K_I}{A \cdot m \cdot s^3 + A \cdot b \cdot s^2 + A \cdot K_O \cdot s + K_Q \cdot K_O \cdot K_I} Vref \quad \text{[Formula 4]}$$

Formula 5 can be obtained by making the time t go to infinity (t to ∞), i.e., by making s go to zero (s to 0) with respect to the step input of the set value Vref of the slide speed using the final value theorem. Formula 5 contains a denominator and a numerator equal to each other, which reduce to 1 and accordingly reveal that the slide speed Vs is equal to the set value Vref.

$$Vs = \frac{K_Q \cdot K_O \cdot K_I}{K_Q \cdot K_O \cdot K_I} Vref \quad \text{[Formula 5]}$$

In Formula 1, assuming that the proportional control gain is Kp=0, Formula 4 can be obtained as described above. Here, a denominator of Formula 4 is used as a stability discriminant, and based on Routh's stability criterion which is generally known in control theory, such conditions as A·m>0, A·b>0, A·Ko>0, $K_Q$·Ko·$K_I$>0, and A·b·A·Ko>A·m·$K_Q$·Ko·$K_I$ are required for stability of the control system. Because conditional expressions of A·m>0, A·b>0, A·Ko>0, and $K_Q$·Ko·$K_I$>0 suffice inherently, a conditional expression α of $K_I < A \cdot b/(m \cdot K_Q)$ can be obtained from a conditional expression of $A \cdot b \cdot A \cdot Ko > A \cdot m \cdot K_Q \cdot Ko \cdot K_I$.

This conditional expression α is a condition that the integral control gain $K_I$ needs to satisfy and requires the integral control gain $K_I$ to satisfy the following conditions (1) to (4).

(1) The integral control gain $K_I$ is required to be increased in proportion to the cylinder sectional area A and is changed at a timing to add the pressure cylinders. By way of example, when three cylinders of the pressure cylinder group 2 are used, the integral control gain $K_I$ is increased three times greater than when one cylinder is used.

(2) The integral control gain $K_I$ is required to be reduced with an increase in mass m of the slide 3.

(3) The integral control gain $K_I$ is to be reduced as a volume or capacity of the pumps 5 increases, i.e., the number of the pumps 5 to be used increases. More specifically, when the number of the pumps 5 to be used is changed, the integral control gain $K_I$ is also changed accordingly.

(4) The friction b of the slide mechanical system (this is considered here to be proportional to the speed) stabilizes a movement of the slide. Accordingly, as can be understood from the conditional expression α, the integral control gain $K_I$ can be increased as a term containing b increases.

The conditions (2) and (4) are mechanical conditions and therefore cannot be changed. On the other hand, the conditions (1) and (3) reveal that when the pressure cylinder(s) are added, i.e., when the cylinder sectional area A is increased, and also when the number of the pumps 5 to be used is changed, the integral control gain $K_I$ is required to be changed accordingly. In the hydraulic forging press 1 according to this embodiment, when the number of the to-be-used cylinders of the pressure cylinder group 2 is increased or when the number of the pumps 5 to be used is increased, set parameters of a control circuit in the pressing speed control system or an equilibrium control system, which will be discussed later, are changed depending on the number of the cylinders or pumps 5 to be used.

FIGS. 4(*a*) to 4(*d*) are a set of illustrations showing another embodiment of the hydraulic forging press shown in FIG. 1. Specifically, FIG. 4(*a*) shows a first stand-by process, FIG. 4(*b*) shows a first pressing process, FIG. 4(*c*) shows a second stand-by process, and FIG. 4(*d*) shows a second pressing process. It is to be noted here that in the following description the first stand-by process and the first pressing process are collectively referred to as a first process, and the second stand-by process and the second pressing process are collectively referred to as a second process.

The embodiment shown in FIG. 4(*a*) to FIG. 4(*d*) is a hydraulic forging press 1 that includes a die retainer unit 31*c* on which a plurality of dies, a first upper die 31*a* and a second upper die 31*b* in this embodiment, are mounted. This hydraulic forging press 1 intends to perform continuous forging while moving the first upper die 31*a* and the second upper die 31*b* and switching therebetween. Because the hydraulic forging press 1 according to this embodiment has a forgeable load range more than ten times wider than that of a conventional forging press, forging associated with a plurality of processes can be performed with one-time heating without reheating a material that has been once heated.

As shown in FIG. 4(*a*), an intermediate die 33, to which a die shift unit 32 is mounted, is mounted on the slide 3. The die shift unit 32 has, for example, a hydraulic cylinder 32*a* for sliding the die retainer unit 31*a* and a guide unit 32*b* mounted on the intermediate die 33 side, and the hydraulic cylinder 32*a* is operated to cause the die retainer unit 31*c*, on which the first upper die 31*a* and the second upper die 31*b* are mounted, to slide along the guide unit 32*b*.

More specifically, as shown in FIG. 4(*a*), the first upper die 31*a* is first placed above a lower die 41 (the first stand-by process). As shown in FIG. 4(*b*), the slide 3 is then moved downward to forge an object Mp with the first upper die 31*a* and the lower die 41 (the first pressing process). As shown in FIG. 4(*c*), the die retainer unit 31*c* is subsequently caused to slide to place the second upper die 31*b* above the lower die 41 (the second stand-by process). As shown in FIG. 4(*d*), the slide 3 is then moved downward to perform die forging of the object Mp with the second upper die 31*b* and the lower die 41 (the second pressing process).

According to the embodiment discussed above, extremely low load forging that cannot be performed by this kind of large forging press can be performed in the first process, and high load forging can be performed by the second upper die 31*b* in the second process without reheating. Because in the hydraulic forging press 1 according to this embodiment a ratio of the load in the first process to that in the second process can be set to more than hundred times, the extremely low load forging and the high load forging can be both performed with one-time heating.

Although in the illustrated embodiments the case in which two kinds of dies, i.e., the first upper die 31*a* and the second upper die 31*b* are disposed as the upper die 31 has been explained, three or more kinds of dies may be disposed as the upper die 31. Also, although the case in which a plurality of dies are disposed on the upper die 31 has been explained, a die shift unit may be mounted on a bolster (not shown) that travels on the bed 4, and a plurality of dies may be disposed on the lower die 41 to be shifted. Also, a plurality of dies may be disposed as each of the upper die 31 and the lower die 41, and the upper die 31 and the lower die 41 may be both shifted.

Figure 5:
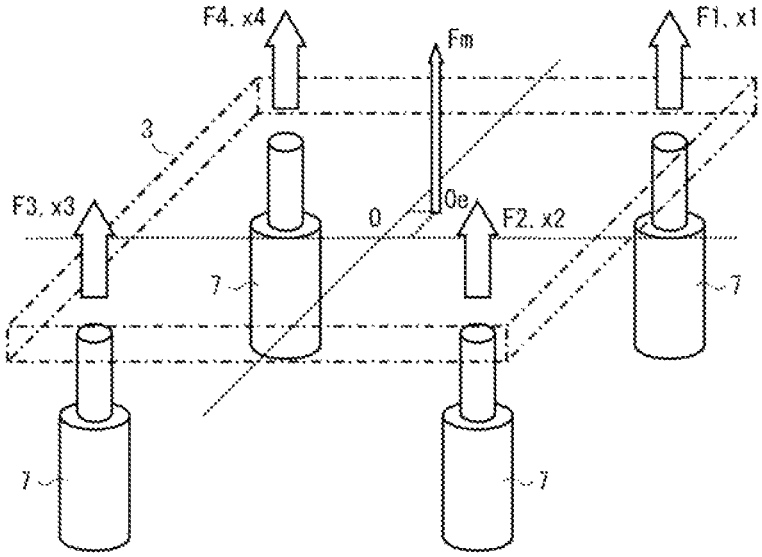
FIG. 5 is an illustration associated with a slide parallel control of the hydraulic forging press shown in FIG. 1.

FIG. 5 is an illustration associated with a slide parallel control of the hydraulic forging press shown in FIG. 1. The hydraulic forging press 1 shown in FIG. 1 has four support cylinders 7 for supporting weight of the slide 3 and controlling parallelism of the slide 3. A small pump 7*a* is disposed in each line for supplying one of the support cylinders 7 with the hydraulic oil, and a throttle 7*b* is disposed in each line for discharging the hydraulic oil from one of the support cylinders 7. In FIG. 5, the slide 3 is illustrated by single-dotted chain lines for the sake of simplicity.

As shown in FIG. 5, a slide center of the slide 3 is denoted by O, and the four support cylinders 7 are arranged to be equally spaced around the slide center O below the slide 3. When a load center Oe is deviated from the slide center O of the slide 3 during forging, an eccentric load Fm acts on the slide 3, and the slide 3 intends to incline. Because the inclined slide 3 brings guides (not shown) of the slide 3 into contact with and into sliding movement with support portions (not shown) of the hydraulic forging press, the press is brought to a stop, or even if the press is not brought to a stop and the forging is still possible, a product shape may be deformed, giving rise to defective products.

Accordingly, in the hydraulic forging press 1, it is important to control the parallelism of the slide 3 for stability of forging operations. For this reason, the hydraulic forging press 1 according to this embodiment includes a controller (not shown) for adjusting the forces of the four support cylinders 7, which support the weight of the slide 3, to correct the inclination of the slide 3.

During forging, the slide 3 shown in FIG. 1 is pressed and caused to be moved downward by the pressure cylinder group 2, and hence, hydraulic oil flows out of the four support cylinders 7 that support the slide 3. The amount of flow is controlled by regulating openings of the throttles 7*b* in such a manner that a moment of rotation that is created by the eccentric load Fm to incline the slide 3 is negated by a moment of rotation that is created by forces F1 to F4 of the four support cylinders 7. More specifically, vertical displacements x1 to x4 of the slide 3 are first measured by displacement sensors (not shown) respectively disposed adjacent to the four support cylinders 7, an average value (x1+x2+x3+x4)/4 thereof is then obtained, and the amounts of flow of the hydraulic oil discharged from the respective support cylinders 7 are eventually controlled by the throttles 7*b* so that each of the vertical displacements x1 to x4 may coincide with the obtained average value.

Although in the foregoing explanation the case in which an auxiliary accumulator 6 is disposed for each auxiliary supply line L11 to L14 has been explained, for example, one auxiliary accumulator 6 may be used for the auxiliary supply lines L11 and L12, and another auxiliary accumulator 6 may be used for the auxiliary supply lines L13 and L14. Alternatively, one auxiliary accumulator 6 may be used for all the auxiliary supply lines L11 to L14.

Also, an explanation has been made as to the case in which the main pressure cylinder 21 and the secondary pressure cylinders 22 to 25 are disposed as the pressure cylinder group 2, and the five pressure cylinders 21, 22 to 25 are all used, but the pressure cylinder group 2 may be configured in such a manner that an upper limit of the number of the to-be-used cylinders of the pressure cylinder group 2 can be set depending on a maximum value of the forging load. In other words, if only low load forging is performed, the upper limit of the number of the to-be-used cylinders of the pressure cylinder group 2 may be set to one, and if forging is performed at a load up to a medium load, the upper limit of the number of the to-be-used cylinders of the pressure cylinder group 2 may be set to three.

The hydraulic forging press 1 discussed above is capable of realizing a method of controlling the hydraulic forging press 1. The hydraulic forging press 1 includes a plurality of pressure cylinders (the pressure cylinder group 2), and the pressure cylinder group 2 has a main pressure cylinder 21 that is capable of constantly supplying the hydraulic oil during forging and at least one secondary pressure cylinder 22 to 25 that are capable of switching a supply and a supply stop of the hydraulic oil depending on the forging load. The method of controlling the hydraulic forging press 1 includes: automatically increasing the number of the to-be-used cylinders of the pressure cylinder group 2, which is achieved by a sequence of supplying the main pressure cylinder 21 with the hydraulic oil, also supplying the secondary pressure cylinders 22 and 23 with the hydraulic oil before the forging load of the main pressure cylinder 21 in use exceeds a predetermined set load W1, and further supplying different secondary pressure cylinders 24 and 25 with the hydraulic oil before the forging load of the pressure cylinder group 2 (for example, the main pressure cylinder 21 and the secondary pressure cylinders 22 and 23) in use exceeds a predetermined set load W2.

In the method of controlling the hydraulic forging press 1, the number of the secondary pressure cylinders 22 to 25 may be increased by two at a time or by one at a time in a manner as discussed above, and can be increased by any other arbitrary combination. Also, when at least one of the secondary pressure cylinders 22 to 25 are to be added, a control gain (for example, an integral control gain $K_I$) of a pressing speed control system may be changed depending on the sum of the cylinder sectional areas A proportional to the number of the cylinders of the pressure cylinder group 2 in use.

According to the hydraulic forging press 1 and the method of controlling the same according to the above-described embodiments, only the main pressure cylinder 21 is used until the forging load exceeds the predetermined set load W1, and after the forging load exceeds the set load W1, the number of the secondary pressure cylinders 22 to 25 to be used is gradually increased as the forging load increases. By doing so, a change in number of the to-be-used cylinders of the pressure cylinder group 2 can be continuously performed without reducing the force of the pressure cylinder group 2 to zero. In other words, the surging of the forging load, which has been hitherto caused by the addition of the cylinders as disclosed in Patent Literature Document 2, or the dead zone where the forging speed becomes zero are not generated by gradually increasing the number of the to-be-used cylinders of the pressure cylinder group 2 without increasing the number of the cylinders to be used by switching the pressure cylinders as in the prior art.

Also, because the forging can be performed using only the main pressure cylinder 21, the hydraulic forging press 1 according to the present invention can adapt not only to forging at an extremely low load (about 1% of the maximum load) but to forging at a desired maximum load by increasing the number of the secondary pressure cylinders 22-25, thus enabling highly accurate forging over a wider range than ever before from the extremely low load (about 1% of the maximum load) to the maximum load.

The present invention is not limited to the embodiments discussed above, but can be changed in various ways unless such changes depart from the spirit of the present invention. By way of example, a configuration of supply lines (pipes) of the hydraulic oil can be appropriately changed within a range in which the present invention can be carried out, or commercially available switching valves can be used upon appropriate selection.

The invention claimed is:

1. A hydraulic forging press comprising a plurality of pressure cylinders, the plurality of pressure cylinders including:

a main pressure cylinder configured to be capable of constantly supplying hydraulic oil during forging; and at least one or more secondary pressure cylinders configured to be capable of switching a supply and a supply stop of the hydraulic oil depending on a forging load, head side hydraulic chambers of the secondary pressure cylinders being connected to a head side hydraulic chamber of the main pressure cylinder through switching valves, respectively, the head side hydraulic chambers of the secondary pressure cylinders being also connected to auxiliary accumulators through the switching valves, and the auxiliary accumulators being configured to be capable of supplying the head side hydraulic chambers with the hydraulic oil when the secondary pressure cylinders are pressurized, the main pressure cylinder and the secondary pressure cylinders being connected to each other by a common supply line and branch supply lines such that the hydraulic oil can communicate between the main pressure cylinder and the secondary pressure cylinders, and the main pressure cylinder being solely used until the forging load exceeds a predetermined set load, and a number of secondary pressure cylinders to be used being gradually increased as the forging load increases after the forging load exceeds the predetermined set load.

2. The hydraulic forging press according to claim 1, wherein the secondary pressure cylinders used during forging are configured to be capable of increasing in number by one cylinder or by several cylinders at a time.

3. The hydraulic forging press according to claim 1, wherein a plurality of different set loads are set to the plurality of pressure cylinders, respectively, depending on the number of the pressure cylinders to be used, and the number of the plurality of the secondary pressure cylinders used during forging increases before the forging load exceeds each of the plurality of different set loads.

4. The hydraulic forging press according to claim 1, wherein the plurality of pressure cylinders are connected to a plurality of pumps configured to supply the hydraulic oil, and a number of pumps among said plurality of pumps to be used during forging is changeable during forging depending on the number of the pressure cylinders to be used during forging and a pressing speed of a slide of the hydraulic forging press during forging.

5. The hydraulic forging press according to claim 4, wherein the pumps are configured to be capable of changing a set pressure, and an applied pressure of the plurality of pressure cylinders is changed by changing the set pressure of the pumps.

6. The hydraulic forging press according to claim 1, wherein the plurality of pressure cylinders are configured to be capable of setting an upper limit of the number of the pressure cylinders to be used depending on a maximum value of the forging load.

7. The hydraulic forging press according to claim 1, further comprising a slide having an upper die and a bed having a lower die, wherein the upper die includes, at least, a first upper die and a second upper die, and a continuous forging is performed while moving and switching the first upper die and the second upper die.

8. The hydraulic forging press according to claim 1, further comprising a slide having an upper die, a bed having a lower die, and a plurality of supporting cylinders configured to hold the slide and control parallelism of the slide.

* * * * *